US006425791B1

(12) United States Patent
Raina et al.

(10) Patent No.: US 6,425,791 B1
(45) Date of Patent: Jul. 30, 2002

(54) METHOD OF MAKING A FIELD EMISSION DEVICE WITH BUFFER LAYER

(75) Inventors: Kanwal K. Raina; James J. Alwan, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 12 days.

(21) Appl. No.: 09/652,746

(22) Filed: Aug. 31, 2000

Related U.S. Application Data

(62) Division of application No. 09/096,085, filed on Jun. 11, 1998, now Pat. No. 6,211,608.

(51) Int. Cl.[7] ..... H01J 9/02
(52) U.S. Cl. ..... 445/24
(58) Field of Search ..... 445/24

(56) References Cited

U.S. PATENT DOCUMENTS

| | | | | |
|---|---|---|---|---|
| 4,931,873 A | * | 6/1990 | Nishiura | 358/213.11 |
| 5,389,570 A | | 2/1995 | Shiozawa | 437/101 |
| 5,394,006 A | | 2/1995 | Liu | 257/506 |
| 5,522,751 A | | 6/1996 | Taylor et al. | 445/50 |
| 5,534,743 A | | 7/1996 | Jones et al. | 313/309 |
| 5,536,993 A | | 7/1996 | Taylor et al. | 313/336 |
| 5,889,361 A | | 3/1999 | Wang et al. | 313/336 |
| 6,015,323 A | | 1/2000 | Moradi et al. | 445/24 |

OTHER PUBLICATIONS

Levine, et al., Benefits of the Lateral Resistor in a FED, Texas Instruments, Dallas, Texas, pp. 67–71; International Vacuum Micro Electronics Conference, Portland, Oregon, Jul., 1995.

Cathey, Jr., Field Emission Displays, Micron Display Technology, Inc.; International Symposium on VLSI Technology Systems and Applications Conference; Taiwan, May, 1995.

Miki et al., A Totally Wet Etch Fabrication Technology for Amorphous Silicon Thin Film Transistors, Mat. Res. Soc. Symp. Proc. vol. 377, pp. 737–743 (1995).

Kuo, Thin Films Transistor with Layered a–Si:H Structure, Mat. Res. Soc, Symp. Proc. vol. 377, pp. 701–707 (1995).

Leuder, Trends of Research in Active Addressing of LCDs, Mat. Res. Soc. Symp. Proc. vol. 377, 847–859 (1995).

Levine, Field Emissions Form Microtip Test Arrays Using Resistor Stabilization Revue. "LeVide, les Couches Minces", Supplement au No. 271–Mars–Avril 1994.

PML 2063 Issue N o. 3, pp. 4,7,8, (Jun. 1992).

Sung Chul Kim et al., Effects of N2 Plasma Treatment of Si02 Gate Insulator in a–Si:H Thin Film Transistor, Mat. Res. Soc. Symp. Proc. vol. 336, pp. 775–780 (1994).

* cited by examiner

*Primary Examiner*—Kenneth J. Ramsey
(74) *Attorney, Agent, or Firm*—Workman, Nydegger & Seeley

(57) ABSTRACT

A field emission device is disclosed having a buffer layer positioned between an underlying cathode conductive layer and an overlying resistor layer. The buffer layer consists of substantially undoped amorphous silicon. Any pinhole defects or discontinuities that extend through the resistor layer terminate at the buffer layer, thereby preventing the problems otherwise caused by pinhole defects. In particular, the buffer layer prevents breakdown of the resistor layer, thereby reducing the possibility of short circuiting. The buffer layer further reduces the risk of delamination of various layers or other irregularities arising from subsequent processing steps. Also disclosed are methods of making and using the field emission device having the buffer layer.

52 Claims, 5 Drawing Sheets

METHOD OF MAKING A FIELD EMISSION DEVICE WITH BUFFER LAYER

RELATED APPLICATIONS

This is a divisional application of U.S. patent application Ser. No. 09/096,085, filed on Jun. 11, 1998, titled Field Emission Device with Buffer Layer and Method of Making, now U.S. Pat. No. 6,211,608, which is incorporated herein by reference.

BACKGROUND OF THE INVENTION

1. The Field of the Invention

The present invention relates to field emission devices. More particularly, the present invention relates to field emission devices having a buffer layer, and to methods of making and using the field emission devices.

2. The Relevant Technology

Integrated circuits are currently manufactured by an elaborate process in which semiconductor devices, insulating films, and patterned conducting films are sequentially constructed in a predetermined arrangement on a semiconductor substrate. In the context of this document, the term "semiconductor substrate" is defined to mean any construction comprising semiconductive material, including but not limited to bulk semiconductive material such as a semiconductive wafer, either alone or in assemblies comprising other materials thereon, and semiconductive material layers, either alone or in assemblies comprising other materials. The term "substrate" refers to any supporting structure. As used herein, "field emission device" is defined to mean any construction for emitting electrons in the presence of an electrical field, including but not limited to an electron emission tip or tip either alone or in assemblies comprising other materials or structures. "Electron emission apparatus" refers to one or more field emission devices or any structure or product including one or more field emission devices.

Recently, miniaturization of structures within integrated circuits has focused attention and effort to incorporating field emission devices within semiconductor substrates. A field emission device typically includes an electron emission tip, or tip, configured for emitting a flux of electrons upon application of an electric field to the field emission device. An array of miniaturized field emission devices can be arranged on a plate and used for forming a visual display on a display panel. Indeed, field emission devices have been shown to be a promising alternative to cathode ray tube display devices. For example, field emission devices may be used in making flat panel display devices for providing visual display for computers, telecommunication, and other graphics applications. Flat panel display devices typically have a greatly reduced thickness compared to the generally bulky cathode ray tubes.

Field emission devices ordinarily include various structures formed from successive layers during the manufacturing process. FIG. 1 illustrates a portion of a conventional flat panel display, including a plurality of field emission devices. Flat panel display 10 comprises a baseplate 12 and a face plate 14. Baseplate 12 includes substrate 16, which is preferably formed from an insulative glass material. Column interconnects 18 are formed and patterned over substrate 16. The purpose and function of column interconnects 18 is disclosed in greater detail below. Furthermore, a resistor layer 20, which is also discussed in greater detail below, may be disposed over column interconnects 18. Electron emission tips 22 are formed over substrate 16 at the sites from which electrons are to be emitted, and may be constructed in an etching process from a layer of amorphous silicon that has been deposited over substrate 16. Electron emission tips 22 are protrusions that may have one of many shapes, such as pyramids, cones, or other geometries that terminate at a fine point for the emission of electrons.

An extraction grid 24, or gate, which is a conductive structure that supports a positive charge relative to the electron emission tips 22 during use, is separated from substrate 16 with a dielectric layer 26. Extraction grid 24 includes openings 28 through which electron emission tips 22 are exposed. Dielectric layer 26 electrically insulates extraction grid 24 from electron emission tips 22 and the associated column interconnects which electrically connect the emission tips with a voltage source 30.

Face plate 14 includes a plurality of pixels 32, which comprise cathodoluminescent material that generates visible light upon being excited by electrons emitted from electron emission tips 22. For example, pixels 32 may be red/green/blue full-color triad pixels. Face plate 14 further includes a substantially transparent anode 34 and a glass or another transparent panel 36. Spatial support structures 39 are disposed between baseplate 12 and face plate 14 and prevents the face plate from collapsing onto the baseplate due to air pressure differentials between the opposite sides of the face plate. In particular, the gap between face plate 14 and baseplate 12 is typically evacuated, while the opposite side of the face plate generally experiences ambient atmospheric pressure.

The flat panel display is operated by generating a voltage differential between electron emission tips 22 and grid structure 24 using voltage source 30. In particular, a negative charge is applied to electron emission tips 22, while a positive charge is applied to grid structure 24. The voltage differential activates electron emission tips 22, whereby a flux of electrons 40 is emitted therefrom. In addition, a relatively large positive charge is applied to anode 34 using voltage source 30, with the result that flux of electrons 40 strikes the face plate. The cathodoluminescent material of pixels 32 is excited by the impinging electrons, thereby generating visible light. The coordinated activation of multiple electron emission tips over the flat panel display 10 may be used to produce a visual image on face plate 16.

FIGS. 2 and 3 further illustrate field emission devices of the prior art. In particular, electron emission tips 22 are grouped into discrete emitter sets 42, in which the bases of the electron emission tips in each set are commonly connected. As shown in FIG. 3, for example, emitter sets 42 are configured into columns (e.g., $C_1$–$C_3$) in which the individual emitter sets 42 in each column are commonly connected. Additionally the extraction grid 24 is divided into grid structures, with each emitter set 42 being associated with an adjacent grid structure. In particular, a grid structure is a portion of extraction grid 24 that lies over a corresponding emitter set 42 and has openings 28 formed therethrough. The grid structures are arranged in rows (e.g., $R_1$–$R_3$) in which the individual grid structures are commonly connected in each row. Such an arrangement allows an X-Y addressable array of grid-controlled emitter sets. The two terminals, comprising the electron emission tips 22 and the grid structures, of the three terminal cold cathode emitter structure (where the third terminal is anode 34 in face plate 14 of FIG. 1) are commonly connected along such columns and rows, respectively, by means of high-speed interconnects. In particular, column interconnects 18 are formed over substrate 16, and row interconnects 44 are formed over the grid structures.

In operation, a specific emitter set is selectively activated by producing a voltage differential between the specific emission set and the associated grid structure. The voltage differential may be selectively established through corresponding drive circuitry that generates row and column signals that intersect at the location of the specific emitter set. Referring to FIG. 3, for example, a row signal along for $R_2$ of the extraction grid 24 and a column signal along column $C_1$ of emitter sets 42 activates the emitter set at the intersection of row $R_2$ and column $C_1$. The voltage differential between the grid structure and the associated emitter set produces a localized electric field that causes emission of electrons from the selected emitter set.

Early field emission devices were assembled without resistor layer 20 and suffered from uneven emission between different electron emission tips 22, with the result that noticeably bright and dim spots were produced on the screens of the flat panel displays. The problem of uneven emission was significantly reduced by including resistor layer 20, shown in FIGS. 1 and 2, between column interconnects 18 and electron emission tips 22. Resistor layer 20 acts as ballast against excessive current through electron emission tips 22, thereby making electron emission roughly uniform among different electron emission tips. Moreover, in the absence of resistor layer 20, short circuiting between column interconnects 18 and row interconnects 44 was sometimes observed.

Significant problems with the resistor layer in the above described device are evident in the prior art. The resistor layer is likely to have at least occasional "pinhole" defects or other discontinuities, which may lead to breakdown of the resistor layer, which can in turn cause short circuiting and failure of the device. Pinhole defects are commonly created during, for example, plasma enhanced chemical vapor deposition (PECVD) of a silane ($SiH_4$) and diborane ($B_2H_6$) mixture to form a boron-doped amorphous silicon resistor layer. In the high pressures of favored high throughput PECVD processes, particles are formed by homogeneous nucleation, in which radicals in the mixture react. These particles may come to rest on the forming resistor layer, thereby causing pinhole defects. Discontinuities in the resistor layer can cause the loss of the benefits for which the resistor layer was used in the first place. Additionally, discontinuities in the resistor layer can present problems when subsequent etching or photolithographic processes are conducted, potentially causing delamination of various layers and other irregularities.

It has been found that the foregoing process of pinhole formation is especially prevalent when large display panels are manufactured. For example, display panels having sides measuring 10 inches or more are particularly prone to experiencing defects generated by homogeneous nucleation.

Reducing the pressure at which the boron-doped amorphous silicon resistor layer is formed will reduce the likelihood of pinhole and other related defects. However, reducing deposition pressure is unsatisfactory for other reasons. The deposition rate of silicon increases with increasing PECVD operating pressure. Accordingly, manufacturing time and expenses are reduced with high pressure. Additionally, high pressure PECVD produces amorphous silicon resistor layers that exhibit little sensitivity to light. In particular, the resistivity of an amorphous silicon layer formed in a PECVD process at a pressure in a range from about 1,200 milliTorr to about 1,500 milliTorr and at an operating power approaching about 300 W varies less than about 5% in response to the presence or absence of light generated during operation of a display panel. Lower pressure PECVD processes, such as those conducted at pressures in a range from about 500 milliTorr to about 800 milliTorr, generally cannot provide such light-insensitive amorphous silicon.

In view of the foregoing, it is clear that there exists a need for a field emission device that has a resistor layer, yet avoids the harmful consequences of pinhole defects. In particular, it would be desirable to provide a field emission device that can be produced using high throughput, high pressure PECVD, while avoiding breakdown conditions of the resistor layer, even if discontinuities in the resistor layer are present.

SUMMARY OF THE INVENTION

The present invention relates to field emission devices that have a buffer layer interleaved between an overlying resistor layer and an underlying substrate. The buffer layer comprises a continuous, substantially undoped amorphous silicon layer. According to the invention, any pinhole defects, discontinuities, microscopic openings, or the like that extend through the resistor layer terminate on the buffer layer. The buffer layer prevents short circuiting between an underlying conductive layer and conductive layers in an overlying gate electrode. Pinhole-induced delamination or other irregularities that might otherwise occur during subsequent processing steps are also prevented by the buffer layer. The invention also contemplates display devices and panels that include field emission devices with the buffer layer. The invention further extends to methods of making and using field emission devices having the buffer layer.

In accordance with the invention as embodied and broadly described herein, a field emission device is provided, having a buffer layer interleaved between an underlying cathode conductive layer and an overlying resistor layer. The cathode conductive layer is arranged in a series of parallel columns over a substrate, which may be glass, semiconductive material, or the like. A dielectric layer is formed over the resistor layer. An extraction grid or a gate electrode layer, including a gate conductive layer and a gate semiconductive layer, is positioned over the dielectric layer. An electron emission tip is formed over the resistor layer and is located within an aperture formed in the gate electrode layer and the dielectric layer. An anode is provided in a face plate positioned over the gate electrode layer so as to receive electrons emitted from the electron emission tips.

According to another embodiment of the invention, an array of the field emission devices as described above are arranged on a baseplate of a flat panel display. The cathode conductive layer is arranged in a series of substantially parallel columns. Likewise, the gate conductive layer is arranged in a series of substantially parallel rows perpendicular to the columns. The anode is provided in a face plate that has an array of cathodoluminescent pixels.

In accordance with the invention, a method of making the above described field emission device is disclosed. A preferable embodiment of the method comprises the following steps: providing a substrate; forming a cathode conductive layer on the substrate, and forming therefrom a series of substantially parallel columns; forming a buffer layer of substantially undoped amorphous silicon on the cathode conductive layer; forming a resistor layer on the buffer layer; forming an emitter layer on the buffer layer, and forming therefrom an electron emission tip; forming a dielectric layer on the resistor layer and on the electron emission tip; forming a gate electrode layer on the dielectric layer; and providing an anode configured and positioned to receive emitted electrons.

Still further in accordance with the invention, a method of using a display panel incorporating the above-described field emission device is disclosed. Each individual or group of electron emission tips has an address referenced by a unique pair of one column and one row. A voltage supply is connected to the column and the row that reference the address of an emission tip to be activated. The emission tip is activated, thereby forming a selected visual display on the display panel.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

The invention described herein is directed to field emission devices having a buffer layer between an overlying resistor layer and an underlying cathode conductive layer. The buffer layer comprises a substantially undoped amorphous silicon layer. Any pinhole defects or other discontinuities that extend through the resistor layer terminate at the buffer layer, and therefore do not affect the electrical properties of the field emission devices.

Figure 4:
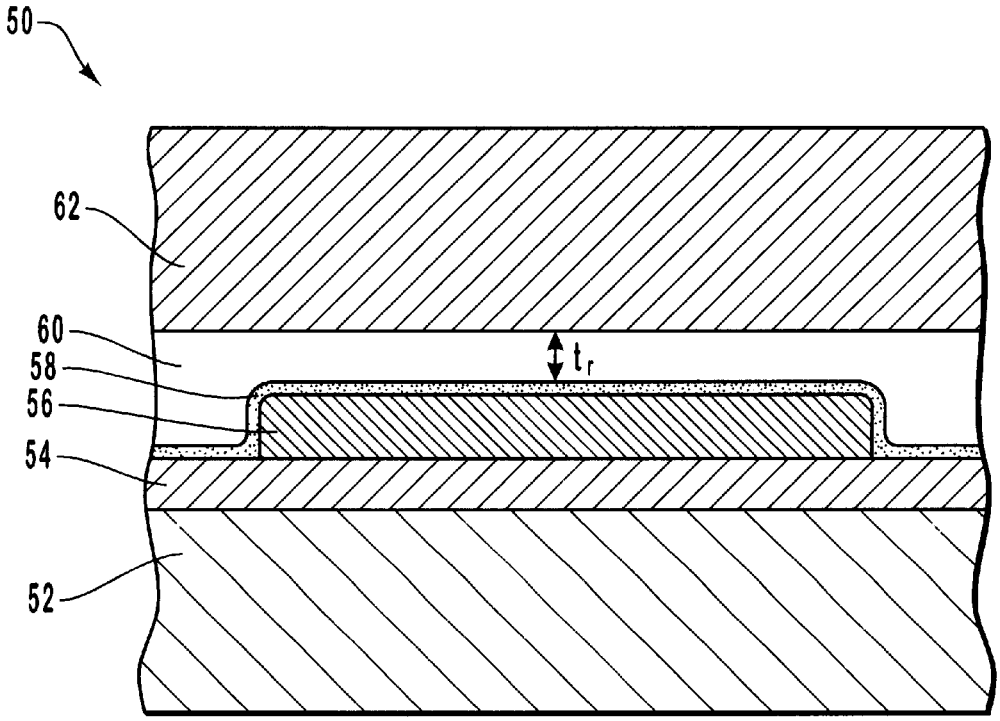
FIG. 4 is a cross section elevation view of a multilayer structure according to the present invention. The multilayer structure includes a substrate, a cathode conductive layer, a buffer layer, and a resistor layer. Also included is an emitter layer that is to be processed to form electron emission tips.

FIG. 4 illustrates a multilayer structure 50 having undergone several initial steps in the process of forming a field emission device according to a preferred embodiment of the invention. A substrate 52, which may be a glass layer, a semiconductor substrate, or the like, is provided. Substrate 52 may be any substrate known in the art on which a field emission device may be assembled. In particular, a soda-lime glass substrate is especially suitable for the present invention. Soda-lime glass, which is characterized by durability and relatively low softening and melting temperatures, commonly contains, but is not limited to, silica ($SiO_2$) with lower concentrations of soda ($Na_2O$), lime (CaO), and optionally oxides of aluminum, potassium, magnesium or tin. Although substrate 52 is electrically insulative, an insulative layer 54 is optionally formed on substrate 52. Insulative layer 54 limits diffusion of impurities from substrate 52 into overlying layers and facilitates adhesion of a subsequent layer. Further, the electrically insulative qualities of insulative layer 54 prevent leakage of current and charge between conductive structures situated thereover. Silicon dioxide is a preferred material for insulative layer 54, and is preferably formed to a thickness in a range from about 2,000 Å to about 2,500 Å, and most preferably, about 2,000 Å.

A cathode conductive layer 56 is formed on insulative layer 54. Preferably, cathode conductive layer 56 is substantially composed of chromium formed by plasma vapor deposition (PVD) sputtering to a thickness in a range from about 2,000 Å to about 2,500 Å. Alternatively, cathode conductive layer 56 may be aluminum or an aluminum/chromium alloy. It is also preferred to pattern cathode conductive layer 56 to form a series of parallel columns by any suitable material removal processes, such as wet etching or other methods that will be understood by those skilled in the art. While the term "columns" is used herein to describe the arrangement of electron emission tips, and the term "rows" is used to describe the arrangement of grid structures, the foregoing terms are selected for purposes of convention. Alternatively, the terms could be reversed.

Buffer layer 58 is formed on both of cathode conductive layer 56 and insulative layer 54. The preferred material for buffer layer 58 is substantially undoped amorphous silicon. Buffer layer 58 may be formed through PECVD of a silane atmosphere having a temperature less than about 400° C., a pressure in a range from about 500 milliTorr to about 1,200 milliTorr, and an operating power in a range from about 200 W to about 500 W. Most preferably, PECVD is conducted at a temperature less than about 350° C. Silane may be introduced at a rate in a range from about 500 standard cubic centimeters per minute (sccm) to about 800 sccm until buffer layer 58 has formed to a thickness in a range from about 200 Å to about 1,000 Å. Most preferably, buffer layer 58 has a thickness in a range from about 800 Å to about 1,000 Å. Temperatures below about 400° C. are important when substrate 52 is a glass layer, so that material deposition will not cause softening or melting of the glass. As will be discussed below, buffer layer 58 provides advantages that overcome problems found in prior art processes and structures.

Resistor layer 60, preferably comprising a boron-doped amorphous silicon layer, is formed on buffer layer 58. For example, the boron-doped amorphous silicon layer can be deposited through PECVD in an atmosphere of a mixture of about 800 parts silane and about 2 parts diborane having a temperature less than about 400° C., at a pressure in a range from about 1000 milliTorr to about 1,500 milliTorr, with the mixture being introduced at a rate preferably greater than about 1,200 sccm. Most preferably, PECVD is conducted at a temperature less than about 350 ° C.

Because cathode conductive layer 56 is ordinarily patterned into columns, the cathode conductive layer is not continuous over substrate 52. Accordingly some portions of resistive layer 60 are positioned over the columns of cathode conductive layer 56, while other portions are not. It is favored to form resistor layer 60 such that the portion of the resistor layer positioned over cathode conductive layer 56 has a thickness $t_r$ in a range from about 3,000 Å to about 5,000 Å. It has been found that boron-doped amorphous silicon having a bulk resistivity in a range, for example, from about $1\times10^3$ ohm-cm to about $1\times10^4$ ohm-cm satisfactorily regulates current flow through many completed field emission devices. By way of example, and not by limitation, resistor layer 60 is doped with boron at a concentration that may be in a range from about $1\times10^{19}$ atoms/cm$^3$ to about $1\times10^{20}$ atoms/cm$^3$. It will be understood by those skilled in the art that the ratio of silane to diborane will be determined by the dopant concentrations desired, and ultimately, by the desired resistivity of resistor layer 60.

Silane is a preferred source of silicon in the PECVD processes because the resulting amorphous silicon layers have some hydrogen alloyed therein. Amorphous silicon is inherently photosensitive, in that electromagnetic radiation can cause variation in its electrical resistivity. Hydrogen alloying reduces photosensitivity and stabilizes resistivity of silicon, which is particularly beneficial in the light-producing display panel applications of the present invention. The concentration of hydrogen is regulated by a suitable power/pressure combination. For example, low power in a range from about 150 W to about 300 W and high pressure in a range of about 1,000 milliTorr to about 1,500 milliTorr are combined to satisfactorily control the amount of hydrogen in resistor layer 60, which subsequently determines the light sensitivity of resistor layer 60.

Emitter layer 62 is formed on resistor layer 60. Emitter layer 62 may be any material from which electron emission tips may be formed, especially those materials having a relatively low work function, so that a low applied voltage will induce a relatively high electron flow therefrom. A preferred material for emitter layer 62 is phosphorus-doped amorphous silicon formed by methods that are understood by those skilled in the art. By way of example, and not by limitation, emitter layer 62 is doped with phosphorus at a concentration that may be in a range from about $1\times10^{20}$ atoms/cm$^3$ to about $1\times10^{21}$ atoms/cm$^3$.

Figure 2:
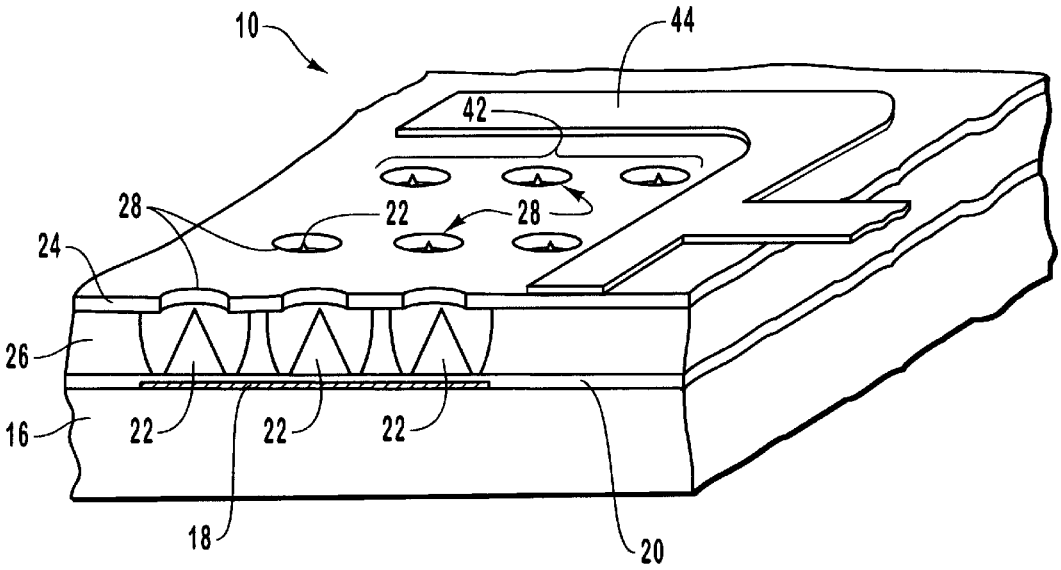
FIG. 2 (PRIOR ART)
FIG. 2 is an isometric view of a baseplate of a prior art flat panel display, showing a emitter set comprising a plurality of electron emission tips.
Figure 3:
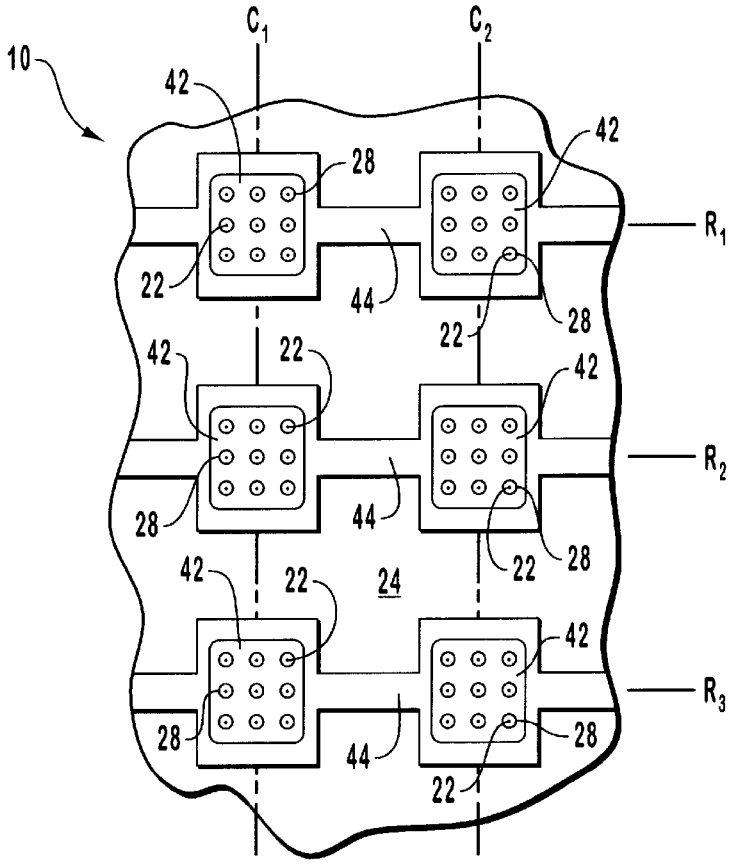
FIG. 3 (PRIOR ART)
FIG. 3 is a top view of the prior art flat panel display of FIG. 2, showing the addressable rows and columns.
Figure 5:
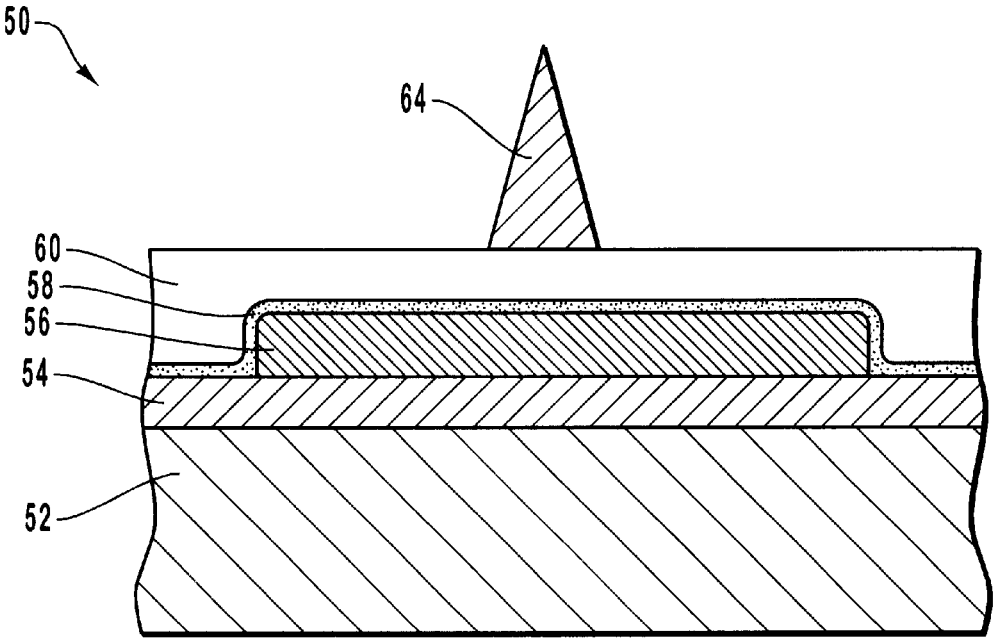
FIG. 5 is a cross section elevation view of the multilayer structure of FIG. 4 further showing the electron emission tips formed from the emitter layer.

Referring now to FIG. 5, electron emission tip 64 is formed from emitter layer 62 by dry etching or other suitable processes whereby material may be selectively removed from emitter layer 62. While as few as one electron emission tip 64 may be formed, in practice, it is common to form an array of as many as tens of millions or more electron emission tips 64 from emitter layer 62. Moreover, while electron emission tips 64 are often grouped together in emitter sets such as emitter sets 42 of FIGS. 2 and 3, only one electron emission tip is illustrated in FIGS. 5–8 for purposes of clarity. It is preferred to fashion an electron emission tip 64 in the form of a protrusion that tapers to an apex extending away from resistor layer 60. Such geometries create a localized work function at the apex that is somewhat lower than the bulk work function of the material used in electron emission tip 64. As a result, a relatively high electron flow can be generated from a given voltage, and electron emission will be substantially limited to the apex.

As seen in FIG. 5, electron emission tips 64 may be formed directly over the column interconnects formed from conductive cathode layer 56. Alternately, the column interconnects may skirt about the periphery of electron emission tips 64 or the periphery of an emitter set comprising multiple electron emission tips instead of passing directly thereunder. Indeed, the relative positioning of the electron emission tips 64 and the associated column interconnects of cathode conductive layer can be selected as desired so long as a sufficient electrical field may be established across the electron emission tips.

Figure 6:
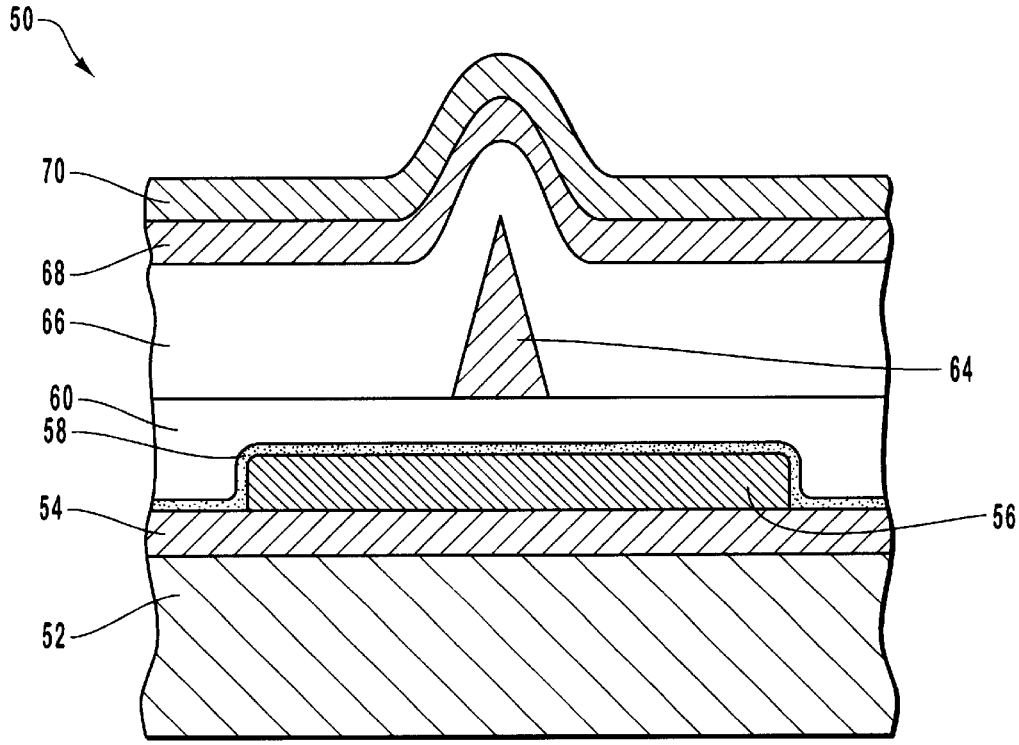
FIG. 6 is a cross section elevation view of the multilayer structure of FIG. 5, further showing a dielectric layer, a gate semiconductive layer, and a gate conductive layer successively formed on the electron emission tips and the resistor layer.

FIG. 6 depicts a dielectric layer 66 formed conformally over electron emission tip 64 and resistor layer 60. The purpose of dielectric layer 66 is to electrically separate electron emission tip 64 and resistor layer 60 from overlying conductive layers. Silicon dioxide is among the suitable materials for dielectric layer 66. Gate semiconductive layer 68 is formed on dielectric layer 66, and contains, for example, phosphorus-doped amorphous silicon, the phosphorus being present, for example, at a concentration that may be in a range from about $1\times10^{20}$ atoms/cm$^3$ to about $1\times10^{21}$ atoms/cm$^3$. Gate conductive layer 70 is formed on gate semiconductive layer 68. Chromium is a preferred material for gate conductive layer 70. Conversely, in an alternate configuration to that shown in FIG. 4, the positions of layers 68 and 70 may be switched, with gate semiconductive layer 68 being positioned over gate conductive layer 70.

Figure 7:
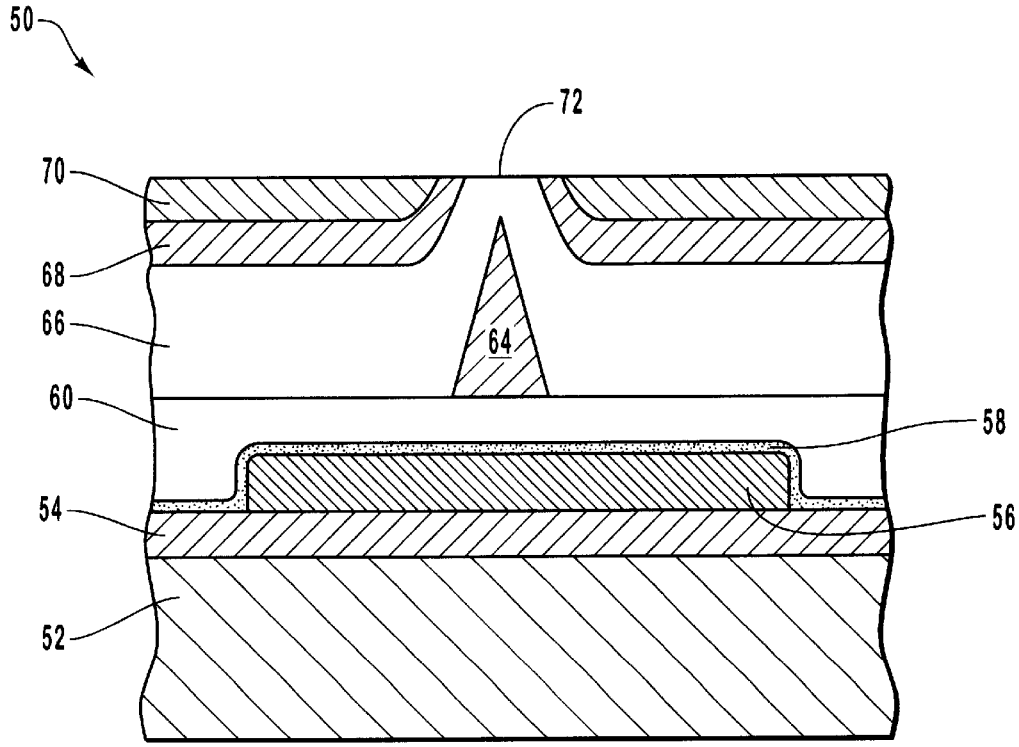
FIG. 7 is a cross section elevation view of the multilayer structure of FIG. 6 after a plananization process is conducted thereon.

As seen in FIG. 7, multilayer structure 50 is planarized using any suitable technique, such as chemical mechanical planarization, to produce planarized surface 72. Planarization is conducted to a depth such that at least some of gate conductive layer 70 is preserved.

Figure 1:
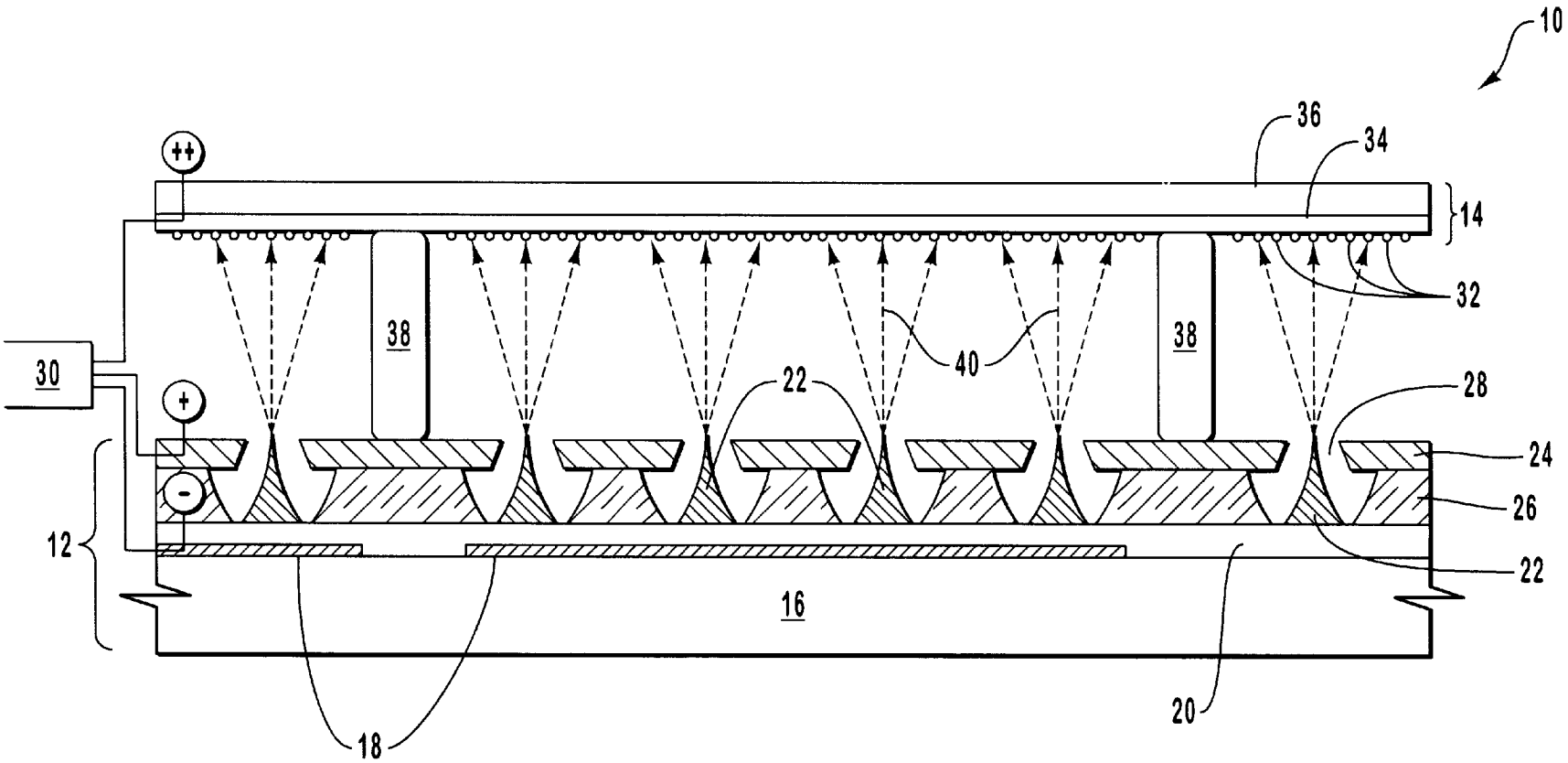
FIG. 1 is a cross section elevation view of a flat panel display including a plurality of field emission devices as practiced in the prior art.
Figure 8:
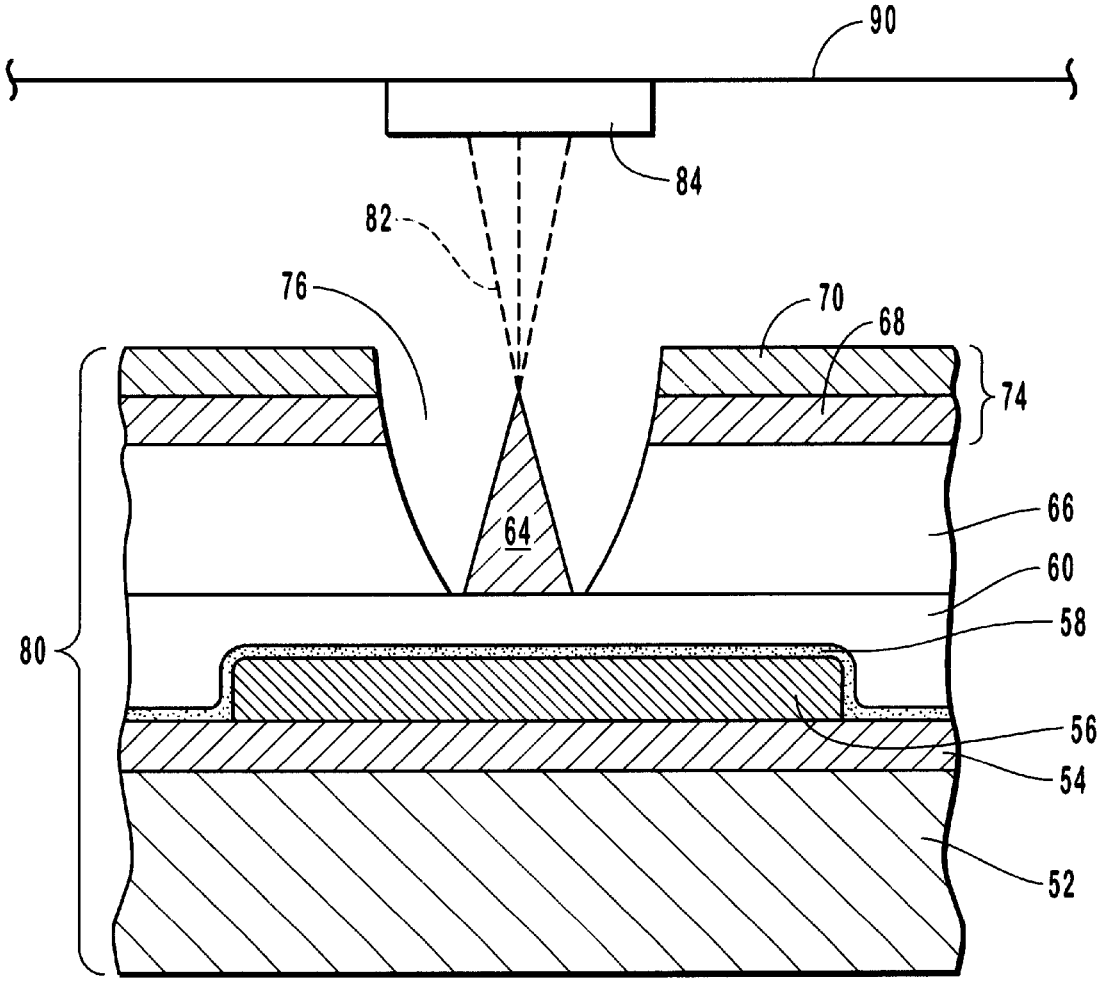
FIG. 8 is a cross section elevation view of the multilayer structure of FIG. 7, further showing an aperture formed through the gate conductive layer, the Rate semiconductive layer, and the dielectric layer to expose the electron emission tips. Also illustrated is a face plate positioned to receive emitted electrons.

Referring to FIG. 8, a portion of dielectric layer 66 is removed through an isotropic etch or another known material removal process to form aperture 76 through which electron emission tip 64 is exposed. The isotropic etch or other known material removal process is preferably selective the material of which electron emission tip 64 is composed. Aperture 76 is positioned around electron emission tip 64, and electron emission tip 64 extends into aperture 76. Portions of gate conductive layer 70 and gate semiconductive layer 68 may need to be removed also, as in FIG. 6, depending on the topology thereof As illustrated in FIG. 8, according to one embodiment of the invention, baseplate 80 comprises cathode conductive layer 56, buffer layer 58, resistor layer 60, electron emission tip 64, dielectric layer 66, gate semiconductive layer 68, and gate conductive layer 70. The extraction gate or the gate electrode 74 comprises gate semiconductive layer 68 and gate conductive layer 70. A face plate 90 is formed over baseplate 80 substantially parallel thereto. Face plate 90 is positioned to receive electrons 82 emitted from electron emission tip 64, and may be any suitable face plate, such as face plate 14 described herein in reference to FIG. 1.

The process of using the field emission device as disclosed herein can be described in reference to FIG. 6. A negative electrical potential with respect to gate electrode 74 is applied to cathode conductive layer 56 by means of a voltage supply, such as voltage supply 30 described herein in reference to FIG. 1. The resulting electrical gradient between cathode conductive layer 56 and gate electrode 74 is sufficient to induce emission of electrons from the apex of electron emission tip 64. The emitted electrons accelerate toward an anode in face plate 90, to which a significantly greater positive electrical potential is applied by means of voltage supply 88. Typical values for the applied voltages are in a range from about 60 volts to about 90 volts between gate electrode 74 and cathode conductive layer 56, and in a range from about 1,000 volts to about 2,000 volts between anode in the face plate 90 and cathode conductive layer 56. In general, low voltages are preferred for power and operation considerations, and the voltages required can be lowered by minimizing dimensions of the field emission device. As electrons 82 strike pixel 84, light is emitted therefrom.

As has been mentioned, the cathode conductive layer 56 may be arranged into column interconnects and rows of grid structures, which are portions of gate electrode 74 adjacent to the corresponding electron emission tips, may be arranged in rows and electrically connected by means of row interconnects. Thus, flat panel displays constructed according to the invention may have matrix-addressable arrays of electron emission tips. Accordingly, the electron emission tips 64 or emitter sets comprising multiple electron emission tips may be selectively activated by applying voltages to the corresponding column interconnect and row interconnect. A suitable manner of selecting a group of electron emission tips for activation is described above in reference to FIGS. 2 and 3, and may be used to selectively activate the electron emission tips of the invention.

Turning now to the purpose of the buffer layer, it should first be recognized that economic considerations encourage manufacturing processes that have high product throughput. Production rates of PECVD processes by which resistor layer 60 is formed can be increased by increasing one or more of pressure, temperature, or operating power. Because glass that is preferably used in substrate 52 constrains the maximum temperature to less than about 400° C., high pressure and relatively high power PECVD is desirable. For example, it has been found that the PECVD process as described above in reference to FIG. 2 can deposit boron-doped amorphous silicon in the resistor layer at a rate approaching about 1,200 Å/min when conducted at a pressure of about 1,200 milliTorr and an operating power approaching about 300 W. On the other hand, reducing the pressure to about 400 milliTorr lowers the deposition rate to a range from about 400 Å/min to about 500 Å/min. Operating power greater than about 300 W is not preferred, because at such high power, the resistivity of resistor layer 60 is somewhat more sensitive to light.

It has been found that at high PECVD pressures, particularly in those above about 1,000 milliTorr, radicals (e.g., $SiH_2$, $SiH_3$, and diborane derivatives) in the plasma mixture react in a process of homogeneous nucleation, whereby microscopic particles are formed. These particles often come to rest upon the forming doped silicon layer. As a result, pinhole defects and related discontinuities appear in resistor layer 60, extending therethrough from a first surface of resistor layer 60 to an opposite second surface.

Reduction of pressure of the PECVD process would alleviate problems associated with the discontinuities, but would also reduce throughput. According to the present invention, high pressure PECVD is used, with accompanying pinhole defects. In response to the discontinuities, the buffer layer is used. Any discontinuities that extend through resistor layer 60 terminate at buffer layer 58, and cannot extend to cathode conductive layer 56.

Pinhole defects and other discontinuities in resistor layer 60 produce problers in at least two areas. First, referring to FIG. 6, discontinuities can cause breakdown of resistor layer 60 to allow free current flow between cathode conductive layer 56 and electron emission tip 64. This presents the possibility of short circuiting between electron emission tips and gate electrode 74. A complete short circuit would flatten the electrical gradient between cathode conductive layer 56 and gate electrode 74, thereby causing failure of an entire field emission display panel. The threat of short circuiting is a significant drawback of using high pressure, high throughput deposition of resistor layer 60.

It has been found that, according to the present invention, any pinhole defects and associated discontinuities terminate on buffer layer 58 without reaching cathode conductive layer 56. Buffer layer 58 provides an additional barrier to free flow of electrical current through a field emission device. Accordingly, buffer layer 58 substantially eliminates the possibility of resistor layer 60 and the short circuiting that might otherwise occur.

A second problem involves processing of the multilayer structure after resistor layer 60 is formed. Pinhole defects in resistor layer 60 act to intensify some etching and photolithographic processes, raising the possibility of delamination of various layers or other irregularities. It has been found that buffer layer 58 reduces these harmful consequences of pinhole defects. The buffer layer 58 and other aspects of the invention have been described in detail herein by making reference to a specific embodiment illustrated in FIGS. 4–8. However, the invention extends to other field emission devices that include a buffer layer formed according to the broad principles taught herein. For example, conventional field emission devices having a wide variety of structures may be advantageously modified with the inclusion of a buffer layer as disclosed herein, and would therefore be encompassed by the invention.

The present invention has application to a wide variety of field emission devices other than those specifically described herein. In particular, the buffer layer as disclosed herein may be used in connection with field emission devices having differing configurations, materials and dimensions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for forming a multilayer structure, said process comprising:

providing a substrate, forming an undoped amorphous silicon layer on said substrate;

forming resistor layer positioned on said undoped amorphous silicon layer; and forming, upon said resistor layer, an electron emission tip for emitting electrons upon being exposed to an electric field.

2. A process according to claim 1, wherein forming an electron emission tip comprises:

forming a doped amorphous silicon layer on said resistor layer, said resistor layer opposing, but not completely preventing, passage of an electrical current therethrough; and forming from said doped amorphous silicon layer a structure protruding away from said resistor layer and tapering to an apex.

3. A process according to claim 1, wherein the multilayer structure is an electron emission apparatus.

4. A process according to claim 1, wherein said resistor layer opposes, but not completely prevents, passage of an electrical current therethrough, said resistor layer comprising boron-doped amorphous silicon.

5. A process according to claim 1, wherein said substrate comprises:

a soda-lime glass layer;

an insulative layer on said soda-lime glass layer; and a conductive layer arranged in parallel columns on said insulative layer.

6. A process according to claim 1, wherein said electron emission tip comprises phosphorus-doped amorphous silicon, said electron emission tip projecting from said resistor layer and tapering to an apex.

7. A process according to claim 1, wherein said resistor layer is composed of an electrically resistive material having a bulk resistivity in a range from about $1\times10^3$ ohm-cm to about $1\times10^4$ ohm-cm.

8. A process according to claim 1, further comprising:

forming a dielectric layer over both of said resistor layer and said substrate;

forming a gate electrode on said dielectric layer including:
a phosphorus-doped amorphous silicon layer; and
a conductive layer; and forming an aperture around said electron emission tip and extending through both of said gate electrode and said dielectric layer, wherein said electron emission tip extends into said aperture.

9. A process according to claim 1, wherein said undoped amorphous silicon layer has a thickness in a range from about 800 Å to about 1,000 Å.

10. A method of making an electron emission apparatus, the method comprising:

forming a resistor layer for opposing, but not completely preventing, passage of an electrical current therethrough, said resistor layer:
being positioned over a substrate;
having first and second opposing surfaces; and
having one or more discontinuities in said resistor layer extending from said first opposing surface to said second opposing surface;

forming an electron emission tip for emitting electrons upon being exposed to an electric field, said electron emission tip being disposed upon said resistor layer; and forming a buffer layer interleaved between said substrate layer and said resistor layer, each of said one or more discontinuities terminating at said buffer layer, said buffer layer preventing delamination of said resistor layer from said substrate.

11. A method of making an electron emission apparatus, the method comprising:

forming a cathode conductive layer over a substrate;

forming a resistor layer for opposing, but not completely preventing, passage of an electrical current therethrough, said resistor layer:
being positioned over said cathode conductive layer;
having first and second opposing surfaces; and
having one or more discontinuities in said resistor layer extending from said first opposing surface to said second opposing surface;

forming an electron emission tip for emitting electrons upon being exposed to an electric field, said electron emission tip being disposed upon said resistor layer;

forming a dielectric layer over both of said substrate and said resistor layer;

forming a gate electrode over said dielectric layer, said gate electrode including a gate conductive layer; and forming a buffer layer interleaved between said cathode conductive layer and said resistor layer, each of said one or more discontinuities terminating at said buffer layer, said buffer layer preventing short circuiting between said gate conductive layer and said cathode conductive layer.

12. A method of making an electron emission apparatus, the method comprising:

providing a substrate including:
a glass layer; and
an insulative layer on said glass layer;

forming a cathode plate on said substrate including:
a cathode conductive layer on said substrate;
an undoped amorphous silicon layer on both of said cathode conductive layer and said insulative layer;
a resistor layer positioned on said undoped amorphous silicon layer; and
an electron emission tip on said resistor layer;

forming a dielectric layer on said cathode plate;

forming a gate electrode on said dielectric layer including:
a gate semiconductive layer; and
a gate conductive layer;

forming an aperture extending through each of said gate conductive layer, said gate semiconductive layer, and said dielectric layer, said aperture being formed around said electron emission tip, said electron emission tip extending into said aperture; and forming an anode plate over said gate electrode, said anode plate being separated from said gate electrode, said anode plate being positioned such that said electron emission tip extends away from said resistor layer toward said anode plate.

13. The method as defined in claim 12, wherein said anode plate comprises a transparent panel and cathodoluminescent material.

14. The method as defined in claim 12, wherein said undoped amorphous silicon layer has an average thickness in a range from about 200 Å to about 1,000 Å.

15. The method as defined in claim 12, wherein said undoped amorphous silicon layer has an average thickness in a range from about 800 Å to about 1,000 Å.

16. The method as defined in claim 12, wherein said undoped amorphous silicon layer has hydrogen alloyed therein.

17. The method as defined in claim 12, wherein said glass layer consists of soda-lime glass.

18. The method as defined in claim 12, wherein said insulative layer comprises silicon dioxide.

19. The method as defined in claim 18, wherein said insulative layer has a thickness in a range from about 2,000 Å to about 2,500 Å.

20. The method as defined in claim 12, wherein said cathode conductive layer comprises a material selected from the group consisting of chromium, aluminum, and alloys of chromium and aluminum.

21. The method as defined in claim 12, wherein said resistor layer opposes, but not completely prevents, passage of an electrical current therethrough, said resistor layer being composed of boron-doped amorphous silicon.

22. The method as defined in claim 21, wherein said resistor layer has hydrogen alloyed therein.

23. The method as defined in claim 21, wherein said resistor layer has a portion positioned over said cathode conductive layer, said portion of said resistor layer having a thickness in a range from about 3,000 Å to about 5,000 Å.

24. The method as defined in claim 21, wherein said boron-doped amorphous silicon contains boron at a concentration in a range from about $1\times10^{19}$ atoms/cm$^3$ to about $1\times10^{20}$ atoms/cm$^3$.

25. The method as defined in claim 12, wherein said electron emission tip consists of phosphorus-doped amorphous silicon.

26. The method as defined in claim 25, wherein said phosphorus-doped amorphous silicon contains phosphorus at a concentration in a range from about $1\times10^{20}$ atoms/cm$^3$ to about $1\times10^{21}$ atoms/cm$^3$.

27. The method as defined in claim 12, wherein said dielectric layer consists of silicon dioxide.

28. The method as defined in claim 12, wherein said gate semiconductive layer consists of phosphorus-doped amorphous silicon.

29. The method as defined in claim 28, wherein said phosphorus-doped amorphous silicon contains phosphorus at a concentration in a range from about $1\times10^{20}$ atoms/cm$^3$ to about $1\times10^{21}$ atoms/cm$^3$.

30. The method as defined in claim 12, wherein said gate conductive layer consists of chromium.

31. The method as defined in claim 12, wherein:

said gate semiconductive layer is on said dielectric layer; and said gate conductive layer is on said gate semiconductive layer.

32. The method as defined in claim 12, wherein:

said gate conductive layer is on said dielectric layer; and said gate semiconductive layer is on said gate conductive layer.

33. The method as defined in claim 12, wherein said resistor layer is composed of an electrically resistive material that has a bulk resistivity in a range from about $1\times10^3$ ohm-cm to about $1\times10^4$ ohm-cm.

34. A method of making an electron emission apparatus, the method comprising:

providing an array of field emission devices, each said field emission device including:

a substrate including:

a glass layer; and an insulative layer on said glass layer;

a cathode plate on said substrate including:

a cathode conductive layer on said substrate;

an undoped amorphous silicon layer on both of said cathode conductive layer and said insulative layer;

a resistor layer positioned on said undoped amorphous silicon layer; and an electron emission tip on said resistor layer;

a dielectric layer on said cathode plate;

a gate electrode on said dielectric layer including:

a gate semiconductive layer; and a gate conductive layer; and an aperture extending through each of said gate conductive layer, said gate semiconductive layer, and said dielectric layer, said aperture being formed around said electron emission tip, said electron emission tip extending into said aperture; and positioning an anode plate over said array of electron emission tips, said anode plate including a display panel having cathodoluminescent material that emits light when excited by electrons.

35. The method as defined in claim 34, wherein:

said cathode conductive layer is arranged in a series of parallel columns; and said gate conductive layer is arranged in a series of parallel lines perpendicular to said columns, each said field emission device having an address referenced by a unique pair of one of said columns and one of said lines.

36. The method as defined in claim 34, wherein said undoped amorphous silicon layer prevents short circuiting between said gate conductive layer and said cathode conductive layer.

37. The method as defined in claim 36, wherein said undoped amorphous silicon layer has an average thickness in a range from about 200 Å to about 1,000 Å.

38. The method as defined in claim 36, wherein said undoped amorphous silicon layer has an average thickness in a range from about 800 Å to about 1,000 Å.

39. The method as defined in claim 36, wherein said glass layer consists of soda-lime glass.

40. The method as defined in claim 36, wherein said resistor layer opposes, but not completely prevents, passage of an electrical current therethrough, sad resistor layer being composed of boron-doped amorphous silicon.

41. The method as defined in claim 34, wherein said resistor layer has a portion over said cathode conductive layer, said portion of said resistor layer having a thickness in a range from about 3,000 Åto about 5,000 Å.

42. The method as defined in claim 40, wherein said boron-doped amorphous silicon contains boron at a concentration in a range from about $1\times10^{19}$ atoms/cm$^3$ to about $1\times10^{20}$ atoms/cm$^3$.

43. The method as defined in claim 36, wherein said electron emission tip consists of phosphorus-doped amorphous silicon.

44. The method as defined in claim 43, wherein said phosphorus-doped amorphous silicon contains phosphorus at a concentration in a range from about $1\times10^{20}$ atoms/cm$^3$ to about $1\times10^{21}$ atoms/cm$^3$.

45. A process for forming a multilayer structure, said process comprising:

providing a glass layer, forming an insulative layer including silicon dioxide on said glass layer;

forming a cathode conductive layer composed of chromium on said insulative layer;

forming from said cathode conductive layer a series of parallel columns;

forming an undoped amorphous silicon layer on said cathode conductive layer;

forming a boron-doped amorphous silicon layer on said undoped amorphous silicon layer;

forming an emitter layer composed of phosphorus-doped amorphous silicon on said boron-doped amorphous silicon layer;

forming an electron emission tip from said emitter layer;

forming a dielectric layer composed of silicon dioxide on both of said boron-doped amorphous silicon layer and said electron emission tip, forming a gate semiconductive layer composed of phosphorus-doped amorphous silicon on said dielectric layer;

forming a gate conductive layer composed of chromium on said gate semiconductive layer;

forming from said gate conductive layer a series of parallel lines perpendicular to said columns;

planarizing said gate conductive layer; and forming an aperture extending through each of said gate conductive layer, said gate semiconductive layer and a portion of said dielectric layer, said aperture being formed around said electron emission tip, said electron emission tip extending into said aperture.

46. A process according to claim 45, wherein forming said undoped amorphous silicon layer is performed by PECVD of silane in an atmosphere having a temperature less than about 400° C., at a pressure in a range from about 500 milliTorr to about 1,200 milliTorr, and at an operating power in a range from about 200 W to about 500 W, said silane being introduced at a rate in a range from about 500 sccm to about 800 sccm until said undoped amorphous silicon layer has a thickness in a range from about 800 Å to about 1,000 Å.

47. A process according to claim 46, wherein said temperature is less than about 350° C.

48. A process according to claim 45, wherein forming said boron-doped amorphous silicon layer is conducted by PECVD of a mixture of silane and diborane in an atmosphere having a temperature less than about 400° C., at a pressure in a range from about 1,000 milliTorr to about 1,500 milliTorr, and at an operating power less than about 300 W, said mixture being introduced at a rate of at least about 1,200 sccm until a portion of said boron-doped amorphous silicon layer that is positioned over said undoped amorphous silicon layer has a thickness in a range from about 3,000 Å to about 5,000 Å.

49. A process according to claim 48, wherein said temperature is less than about 350° C.

50. A process according to claim 45, wherein forming said electron emission tip from said emitter layer is performed by a dry etch of said emitter layer.

51. A process for forming a multilayer structure, said process comprising;

providing a substrate;

forming an undoped amorphous silicon layer over said substrate by PECVD of silane in an atmosphere having a temperature less than about 400° C., at a pressure in a range from about 500 milliTorr to about 1,200 milliTorr, and at an operating power in a range from about 200 W to about 500 W, said silane being introduced at a rate in a range from about 500 sccm to about 800 sccm until said undoped amorphous silicon layer has a thickness in a range from about 800 Å to about 1,000 Å;

forming a boron-doped amorphous silicon layer on said undoped amorphous silicon layer by PECVD of a mixture of silane and diborane in an atmosphere having a temperature less than about 400° C. and at a pressure in a range from about 1,000 milliTorr to about 1,500 milliTorr, said mixture being introduced at a rate of at least about 1,200 sccm until a portion of said boron-doped amorphous silicon layer that is positioned over said undoped amorphous silicon layer has a thickness in a range from about 3,000 Å to about 5,000 Å;

forming a phosphorus-doped amorphous silicon layer on said boron-doped amorphous silicon layer; and forming an electron emission tip from said phosphorus-doped amorphous silicon layer, said electron emission tip being configured for emitting electrons upon being exposed to an electric field.

52. A process for providing a selected visual display on a display panel, said process comprising:

providing a matrix-addressable array of electron emission tips including:

a plurality of conductive columns;

a plurality of conductive lines;

a substrate;

an undoped amorphous silicon layer on said substrate;

a resistor layer for opposing, but not completely preventing, passage of an electrical current therethrough, said resistor layer being positioned on said undoped amorphous silicon layer; and a plurality of electron emission tips for emitting electrons upon being exposed to an electric field, said electron emission tips being disposed upon said resistor layer, each of said electron emission tips corresponding to an address pair consisting of one of said conductive lines and one of said conductive columns;

providing a display panel having cathodoluminescent material over said array of electron emission tips; and selectively activating one or more of said electron emission tips by establishing an electrical gradient between said conductive lines and said conductive columns of said address pairs that correspond thereto, thereby providing said selected visual display on said display panel.

* * * * *

UNITED STATES PATENT AND TRADEMARK OFFICE

CERTIFICATE OF CORRECTION

PATENT NO. : 6,425,791 B1 
DATED : July 30, 2002
INVENTOR(S) : Kanwal K. Raina and James J. Alwan It is certified that error appears in the above-identified patent and that said Letters Patent is hereby corrected as shown below:

Column 2,
Line 22, change "39" to -- 38 --

Column 5,
Line 45, change "plananization" to -- planarization --
Line 50, change "Rate" to -- gate --

Column 8,
Line 16, change "$10^{2l}$" to -- $10^{21}$ --

Column 14,
Line 18, after "portion" insert -- positioned --
Line 20, change "Åto" to -- Å to --

Signed and Sealed this

Tenth Day of December, 2002

JAMES E. ROGAN
*Director of the United States Patent and Trademark Office*